United States Patent [19]

Shingai

[11] 4,195,600

[45] Apr. 1, 1980

[54] CRANKCASE CHAMBER COMPRESSION TYPE TWO CYCLE INTERNAL COMBUSTION ENGINES

[75] Inventor: Yoshisuke Shingai, Hamamatsu, Japan

[73] Assignee: Yamaha Hatsudoki Kabushiki Kaisha, Iwata, Japan

[21] Appl. No.: 920,643

[22] Filed: Jun. 30, 1978

Related U.S. Application Data

[63] Continuation of Ser. No. 677,252, Apr. 15, 1976, abandoned.

[51] Int. Cl.[2] ..... F02B 33/04

[52] U.S. Cl. ..... 123/73 AA; 123/73 A; 123/73 PP; 123/196 CP; 184/6.8; 92/160

[58] Field of Search ..... 184/6.8; 92/160, 154, 92/237; 123/73 AA, 73 A, 73 AD, 73 AF, 73 CC, 73 SC, 73 PP, 73 B, 65 A, 196 CP, 196 M

[56] References Cited

U.S. PATENT DOCUMENTS

| | | | |
|---|---|---|---|
| 1,172,472 | 2/1916 | McCornack | 123/73 CC |
| 1,537,616 | 5/1925 | Mellen | 123/73 CC |
| 1,852,986 | 4/1932 | Tartrais | 123/73 AA |
| 1,883,637 | 10/1932 | Edwards | 92/160 |
| 1,998,392 | 4/1935 | Skarlund | 123/196 CP |
| 2,147,956 | 2/1939 | Alexandrescu | 92/237 |
| 2,352,592 | 7/1944 | Alexandrescu | 92/160 |
| 2,416,429 | 2/1947 | Boucher | 184/6.8 |
| 2,669,980 | 2/1954 | Yarrington | 123/73 A |
| 2,983,334 | 5/1961 | Dalrymple | 123/196 CP |
| 3,257,997 | 6/1966 | Sheaffer | 123/73 AA |
| 3,800,753 | 4/1974 | Sullivan et al. | 123/73 AA |
| 3,805,751 | 4/1974 | Resnick et al. | 123/196 CP |
| 3,973,532 | 8/1976 | Litz | 184/6.8 |

FOREIGN PATENT DOCUMENTS

| | | | |
|---|---|---|---|
| 518509 | 11/1955 | Canada | 184/6.8 |
| 1014387 | 8/1957 | Fed. Rep. of Germany | 184/6.8 |
| 1081882 | 5/1953 | France | 123/73 AA |
| 214687 | 10/1939 | Switzerland | 123/73 AA |

*Primary Examiner*—William R. Cline
*Assistant Examiner*—H. Jay Spiegel
*Attorney, Agent, or Firm*—Charles E. Pfund

[57] ABSTRACT

In the engine the side wall of the piston is provided with a perforation at a portion not facing an exhaust port of the cylinder for communicating the cylinder wall with the crankcase chamber.

4 Claims, 6 Drawing Figures

CRANKCASE CHAMBER COMPRESSION TYPE TWO CYCLE INTERNAL COMBUSTION ENGINES

This is a continuation, of application Ser. No. 677,252 filed Apr. 15, 1976 now abandoned.

BACKGROUND OF THE INVENTION

This invention relates to a two cycle engine, more particularly to a crankcase chamber compression type two cycle internal combustion engine.

The internal combustion engine of this type comprises a cylinder, a piston reciprocating in the cylinder, a crankcase chamber, a crankshaft rotatably supported in the crankcase chamber, a connecting rod for connecting the piston to the crankshaft, a scavenging passage provided through the side wall of the cylinder for communicating crankcase chamber with a combustion chamber in the cylinder through at least one scavenging port opened and closed in relation to the reciprocating motion of the piston, an intake passage communicating with the crankcase chamber through an intake port and an exhaust passage communicated with the combustion chamber in the cylinder which are constructed to cyclically repeat the scavenging-compression-suction-and explosure steps thus imparting a reciprocating motion to the piston. The engine of this type is termed a two cycle engine and is now used extensively.

Among the lubricating systems utilized for the two cycle engine of the type referred to above are included a mixed lubricating system wherein minute particles of the lubricating oil is mixed with a fuel-air mixture so as to admit the lubricant component into the crankcase chamber together with the fuel component thus supplying the lubricant to the sliding members and the rotary members of the engine, and an independent lubricating system wherein an oil tank and an oil pump are provided for supplying to various portions of the engine a required quantity of the lubricating oil independently of the fuel. One type of the former system is disclosed in U.S. Pat. No. 3,687,118. When compared with the independent lubricating system the mixed lubricating system is advantageous in that it does not need a complicated lubricant supply device so that it is used extensively in engines of small size. With this lubricating system, however, the lubricant is equally supplied to portions not requiring a large quantity of the lubricant and portions requiring the largest quantity of the lubricant, so that not only the consumption of the lubricant is large but also adequate quantity of the lubricant is not assured to portions requiring different quantities of the lubricant.

Generally, the lubricant is used to form an oil film between sliding members so as to prevent direct contact of the sliding members thereby decreasing frictional resistance and to remove the heat caused by friction thus cooling the sliding members. Accordingly, the engine should be constructed such that the lubricant can fully develop its function.

Further, the total amount of the lubricant supply is determined by taking the portions requiring the largest supply of the lubricant as the reference. Accordingly the lubricant consumption is larger than the quantity of the lubricant when it is supplied most adequately, thus resulting in the waste of the lubricant. If the lubricant component in the fuel-air mixture were excessive, when the mixture is burned in the combustion chamber, the excess lubricant will be discharged through the exhaust pipe without being burnt. In an extreme case, it will be discharged as a white fume causing pollution of the atmosphere or water.

To solve these problems the lubricant supply may be decreased below the optimum value. This solution can obviate the above described problems but results in the shortage of the lubricant supply so that lubrication and cooling of the portions of sliding surfaces of the piston and the cylinder near the exhaust port would become insufficient.

More particularly, in the two cycle engine of this type, members normally in direct contact with the atmosphere in the crankcase chamber such as the inner wall surface of the piston and the connecting rod are easy to cool and supplied with an adequate quantity of the lubricant. However, only a portion of the periphery of the piston through which the scavenging port extends contacts the atmosphere in the crankcase chamber. With regard to the periphery of the cylinder, the lower portion thereof comes to contact with the fuel-air mixture containing the lubricant in the crankcase chamber when the piston rises whereas when the piston descends the upper portion comes to contact with the mixture. For this reason, supply of the lubricant to the contact surface between the cylinder and piston is more difficult than other portions. Especially, portions such as the portions of the cylinder wall near the exhaust port where heat concentration is serious require a large quantity of lubricant supply. Yet with the present design, the quantity of the lubricant supplied to these portions is deficient.

SUMMARY OF THE INVENTION

Accordingly, it is the principal object of this invention to provide a crankcase chamber compression type two cycle internal combustion engine provided with an economical mixed lubricating system capable of preventing wasteful use of the lubricant.

Another object of this invention is to provide a crankcase chamber compression type two cycle internal combustion engine capable of decreasing the supply quantity of the lubricant component into the fuel-air mixture thereby decreasing as far as possible pollution of the atmosphere as well as water.

A further object of this invention is to provide an improved crankcase chamber compression type two cycle internal combustion engine capable of assuring an adequate supply of the lubricant to portions where heat concentration is severe such as the portion of the cylinder wall near the exhaust port and capable of decreasing excessive consumption of the lubricant.

According to this invention, these and other objects can be accomplished by providing a crankcase chamber compression type two cycle internal combustion engine of the type comprising a cylinder, a piston reciprocating in the cylinder, a crankcase chamber defined by the crankcase, cylinder and piston, a crankshaft rotatably supported by the crankcase, a connecting rod for operatively connecting the piston to the crankshaft, a scavenging passage adapted to communicate the crankcase chamber with the combustion chamber in the cylinder through at least one scavenging port provided through the side wall of the cylinder and opened and closed by the reciprocating movement of the piston, an intake passage communicated with the crankcase chamber through an intake port, and an exhaust passage communicated with the combustion chamber in the cylinder through an exhaust port, characterized in that the side wall of the piston is provided with a perforation for communicating the cylinder wall with the crankcase chamber at a position not facing the exhaust port of the cylinder, and that the perforation includes a portion not facing the intake port and the scavenging port.

According to a modified embodiment, the invention is embodied in a two cylinder type engine. In this modification, a conduit is provided for conveying lubricant from the lubricant reservoir in one crankcase chamber to the connecting rod in the other crankcase chamber by using the pressure difference between two cylinders.

DESCRIPTION OF THE PREFERRED EMBODIMENTS

Figure 1A:
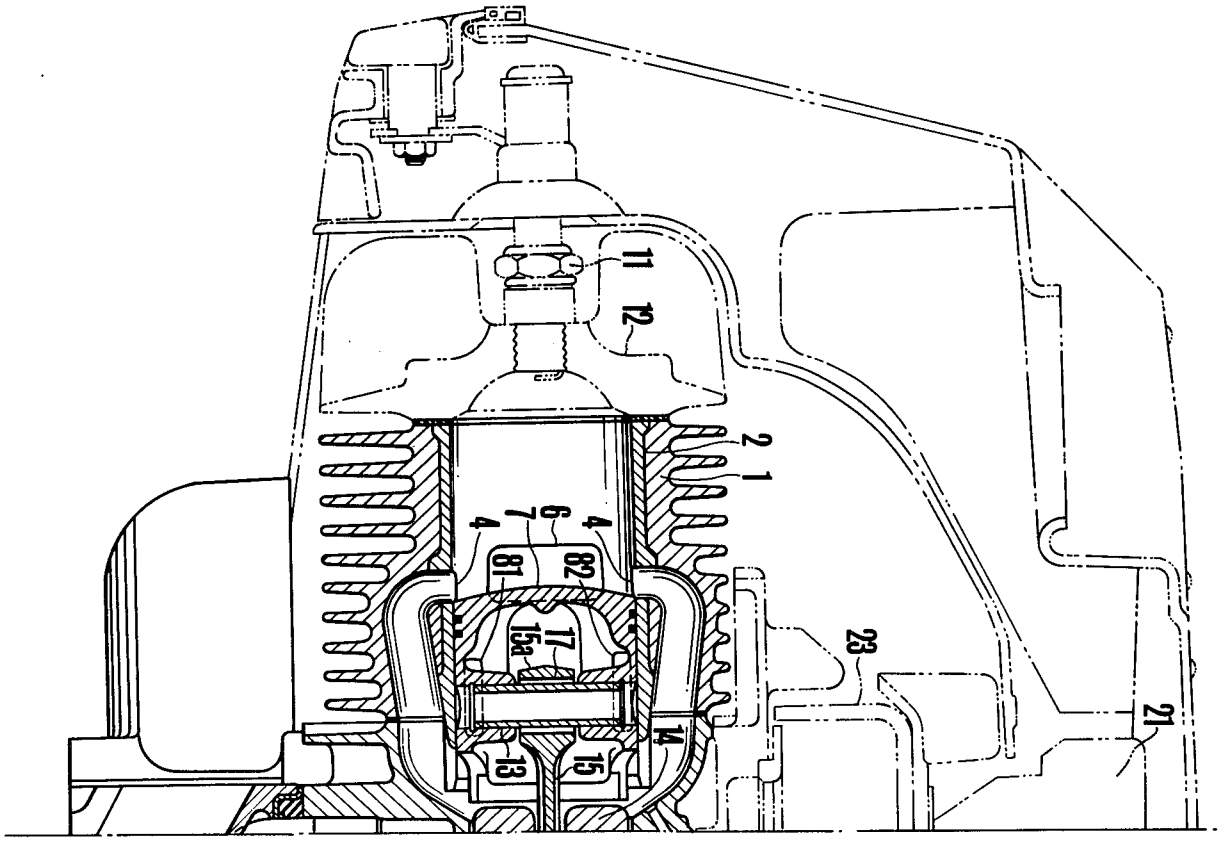
FIGS. 1A and 1B, when combined, show a longitudinal sectional view of a crankcase chamber compression type outboard engine embodying the invention.
Figure 1B:
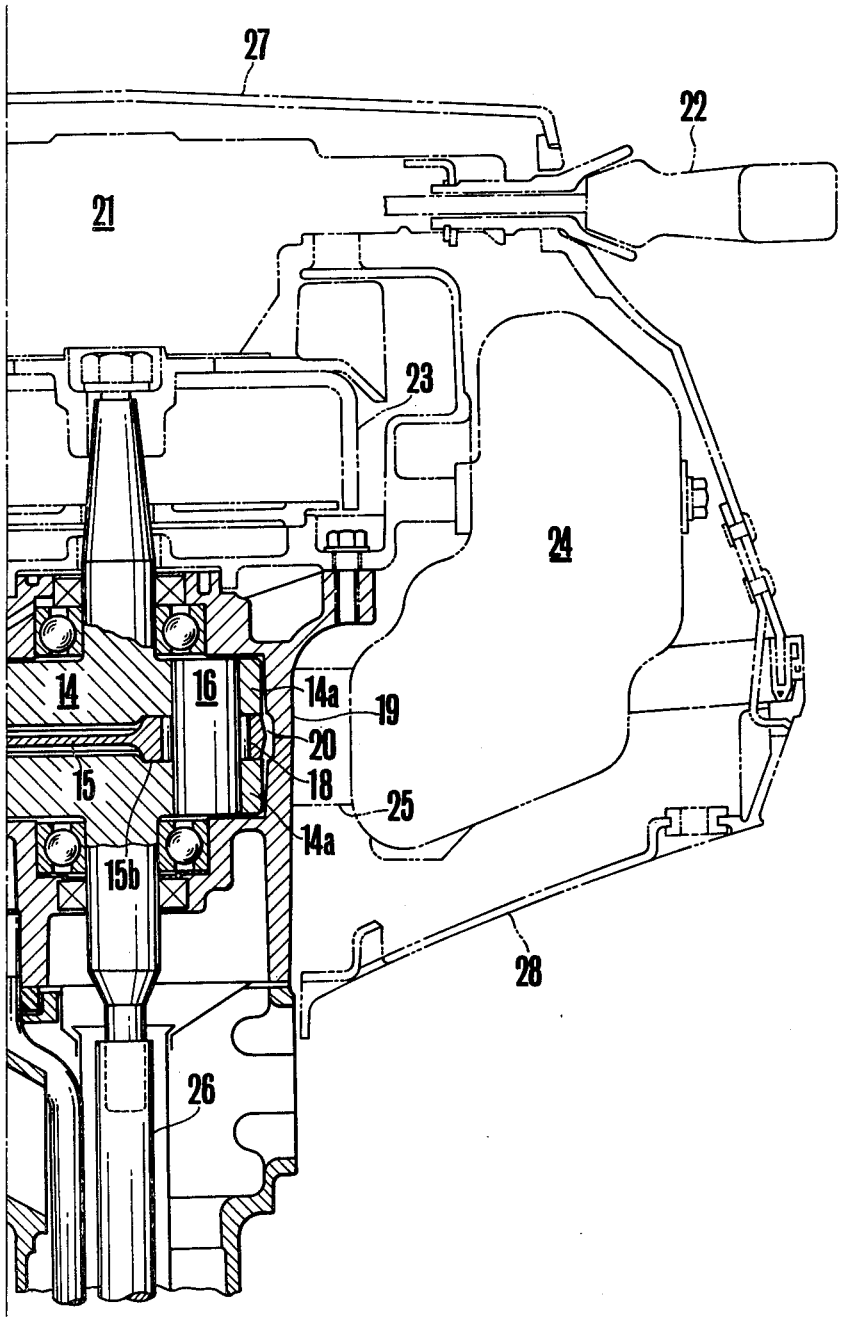
Figure 2A:
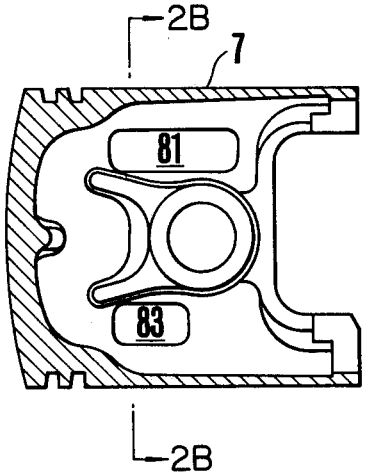
FIG. 2A is a longitudinal sectional view of a piston utilized in the engine shown in FIG. 1.
Figure 2B:
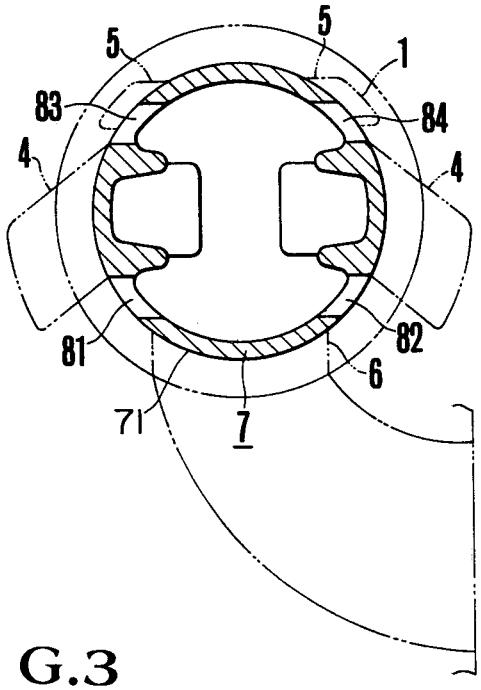
FIG. 2B is a cross-sectional view of the piston shown in FIG. 2A taken along a line 2B—2B.
Figure 3:
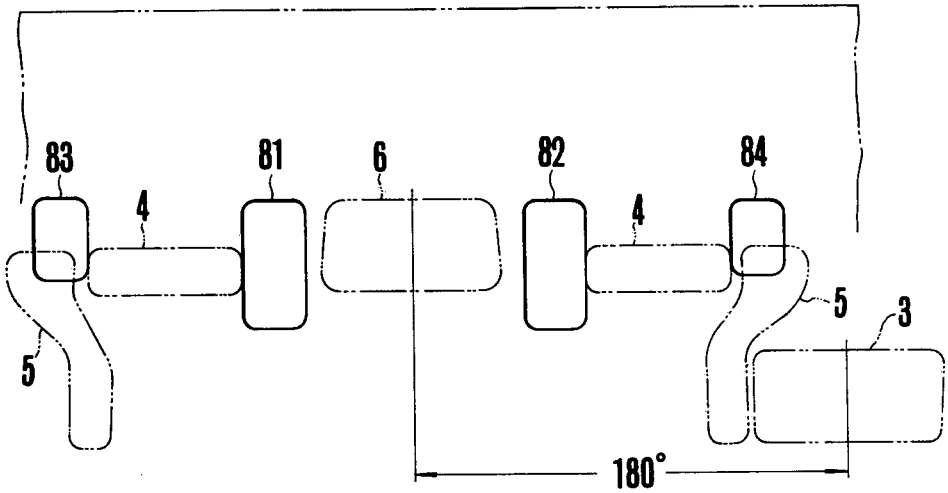
FIG. 3 is a developmental view of the cylinder and piston shown in FIG. 1 showing the relationship between the cylinder wall and the piston periphery.

FIGS. 1 to 3 show a preferred embodiment of this invention especially suitable as an outboard engine.

The engine comprises a cylinder 1 lined with a cylinder sleeve 2 and the inner wall thereof subjected to substantially uniform horning treatment is provided with an intake port 3 FIG. 3, a main scavenging port 4, an auxiliary scavenging port 5 FIG. 2B and an exhaust port 6. A piston 7 is slidably contained in cylinder 1 and the cylindrical side wall 71 of the piston is provided with four rectangular perforations 81 through 84 of two types FIGS. 2A and 2B. Perforations 81 and 82 have longer axial length than other perforations 83 and 84 as shown in FIG. 3. Further, as shown in FIGS. 2 and 3, perforations 81 through 84 are formed at suitable spacings around the side wall 71 of piston 7 at positions not facing the exhaust port 6 through the wall of the cylinder 1. As best shown in FIG. 3, even the perforations 81, 82 closest to the exhaust port 6 are positioned such that they will never overlap the exhaust port 6 during the reciprocation of the piston.

An ignition plug 11 is mounted on the inner surface of the a cylinder head 12 to face the combustion chamber, and the cylinder head 12 is provided to define the combustion chamber together with cylinder 1 and piston 7. The piston 7 is connected to crankshaft 14 through a piston pin 13, a connecting rod 15 and a crankpin 16. Bearings 17 and 18 are interposed between the piston pin 13 and a smaller end **15*a* of connecting rod 15 and between the larger end 15*b* thereof and the crankpin 16. The crankshaft 14 is rotatably supported by a crankcasing 19 to form a crankcase chamber 20 containing a crankarm 14*a*. On one end of the crankcasing are secured a recoil-starter having a handle 22 and a fly wheel magneto 23. An air cleaner and a carbureter which are generally designated by a reference numeral 24 are positioned on one side of the engine. The carbureter is communicated with the intake port 3 through an intake duct 25. The crankshaft 14 is connected to a propeller shaft (not shown) of the boat through a drive shaft 26. The engine and attachemnts thereof are covered by a top cowling 27 and a bottom cowling 28**.

As the piston of the engine of this invention is constructed as above described, a fresh fuel-air mixture sucked in the crankcase chamber 20 comes into direct contact with the inner wall surface of the cylinder 1 through the side wall of the piston 7 through perforations 81 through 84. This increases the interval in which the fresh fuel-air mixture contacts the sliding surface between the inner wall surface of the cylinder and the outer surface of the piston thereby increasing the chance of the lubricant contained in the fresh fuel-air mixture to deposite on the sliding surface.

Further, as the perforations 81, 82 are provided through the side wall of the piston at portions close to the exhaust port 6 but not to facing thereto, the quantity of the lubricant supplied to the portion near the exhaust port is increased thereby increasing the cooling effect of this portion.

Thus, according to this invention it is possible to supply a sufficient quantity of lubricant to the portion of the cylinder wall which requires abundant supply of the lubricant but has been most difficult to supply the lubricant by a simple construction of forming perforations through the side wall of the piston. Accordingly, it is possible to effectively lubricate the engine with smaller quantity of the lubricant than the prior art engine. Consequently, it is possible to reduce the quantity of the lubricant to be admixed with the fuel-air mixture so that pollution of the exhaust gas can be decreased. This is also effective to prevent contamination of the ignition plug and exhaust pipe. It will be clear that it is possible to increase or decrease the number of perforations, but those perforations should not be disposed exactly facing the scavenging and/or the intake ports. Such an arrangement of perforations and the ports gives an undesirable influence to the timing. Consequently, the perforations characterized by the present invention should include an area where the perforations and said scavenging port and/or the intake port at least do not face each other, as indicated by reference numerals 83 and 84 in FIG. 3. Further, the shape of the perforations is not limited to rectangular but may be any other shape such as circular or elliptical. The size and the length of the perforations in the direction of reciprocation of the piston are also variable. Thus, the number, size and shape of the perforations may be determined at will so long as they do not impair the required rigidity of the piston, because they do not affect the operating timing of the engine.

Figure 4:
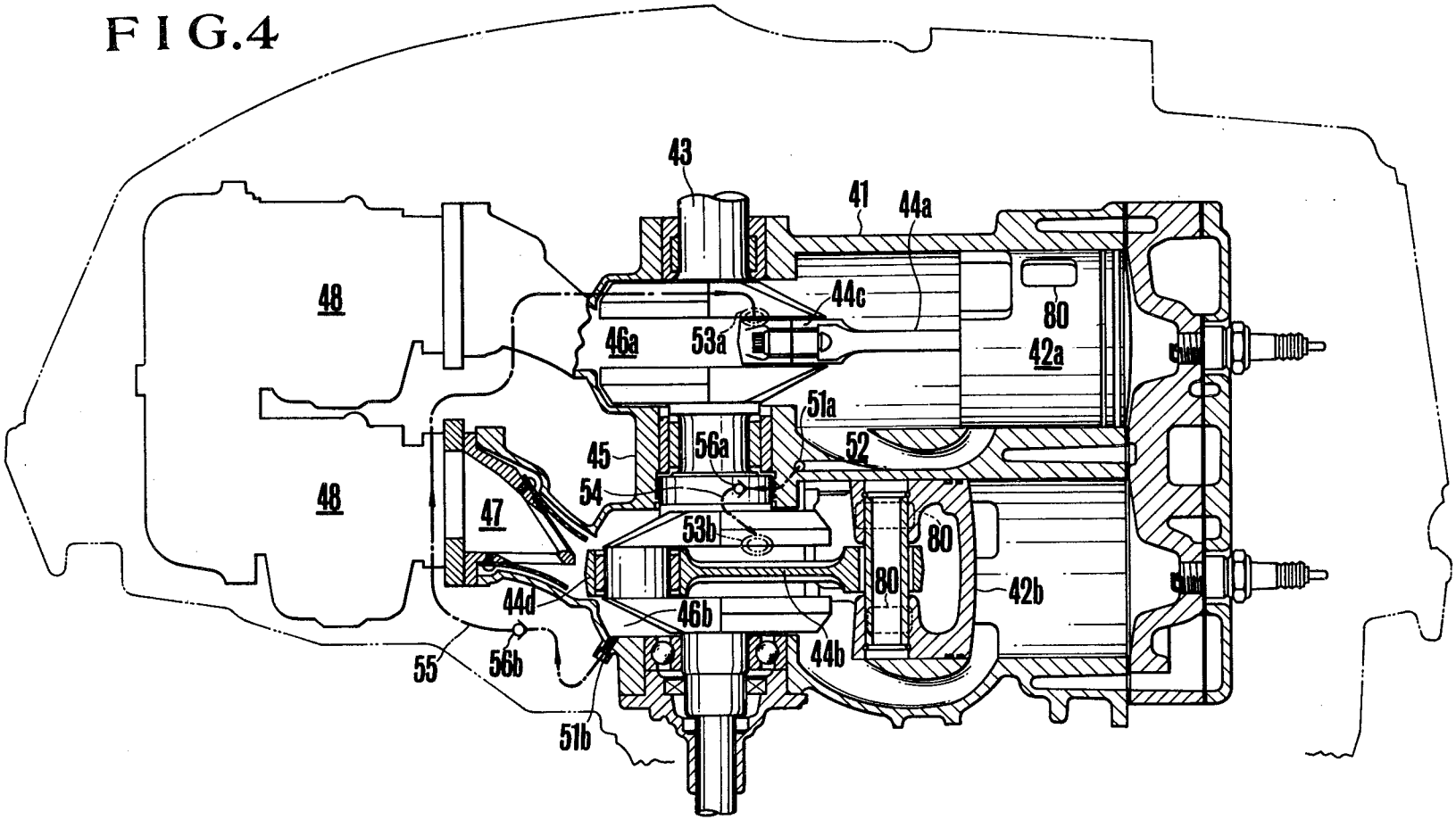
FIG. 4 is a longitudinal sectional view of a modification of this invention.

FIG. 4 shows a two cylinder, two cycle engine embodying the invention and comprising a cylinder casing 41, two pistons **42*a* and 42*b*, a 180 crankshaft 43, connecting rods 44*a* and 44*b* connecting the crankshaft with the pistons 42*a* and 42*b* respectively, a crankcasing 45 forming crankcase chamber 46*a* and 46*b* and lead valves 47 (only one is shown) disposed between the crankcase chamber and carburetters 48. For the sake of simplicity, the perforation characterizing the invention is shown only one at 80**.

As described above, according to this invention, the quantity of the lubricant added to the fuel-air mixture is reduced so that the supply of the lubricant to the larger ends **44*c* and 44*d* of the connecting rods 44*a* and 44*b* may become deficient. To overcome this difficulty an additional lubricating device is provided for this embodiment. More particularly this additional lubricating device is constructed to utilize the pressure difference between two cylinders during running of the two cylinder, two cycle engine so as to supply lubricant to the larger end of the connecting rod contained in one crankcase chamber from a lubricant reservoir at the bottom of the other crankcase chamber, for example, for efficiently lubricating the larger ends of the connecting rods. Thus, as shown in FIG. 4, openings 51***a* and 51*b* are provided for a scavenging passage 52 and a crankcase chamber 46*a* where lubricant (contained in the fuel-air mixture) tends to accumulate and lubricant ejection openings 53*a* and 53*b* are provided at the portions of the larger ends 44*c* and 44*d* of the connecting rods 44*a* and 44*b* located between 90° and 0° prior to the top dead center. Lubricant conduits 54 and 55 respectively including check valves 56*a* and 56*b* are provided between the opening 51*a* and the lubricant ejection opening 53*a* and between the opening 51*b* and the lubricant ejection opening 53*a*.

When pistons 42*a* and 42*b* are in the state shown in FIG. 4, the pressure in the crankcase chamber 46*b* is higher than that in the crankcase chamber 46*a* so that the lubricant collected in the crankcase chamber 46*b* near opening 51*b* is conveyed to the lubricant ejection opening 53*a* through check valve 56*b* and lubricantconduit 55. At this time, since piston 42*a* reaches the top dead center or a point near it the larger end 44*c* of the connecting rod 44*a* approaches the lubricant ejection opening 53*a*. Thus, the lubricant ejected from the opening 53*a* efficiently lubricate the larger end 44*c*. Before the state shown in FIG. 4 that is during the course in which the piston 42*b* moves from the top dead center to the bottom dead center, the pressure in the crankcase chamber 46*b* increases gradually, whereas during the course in which piston 42*a* moves from the bottom dead point to the top dead point the pressure in the crankcase chamber 46*a* gradually decreases so that the pressure in the crankcase chamber 46*b* comes to exceed the pressure in the crankcase chamber 46*a* at which time the convey of the lubricant begins and continues until the state shown in FIG. 4 is reached.

Similarly when the pressure in the crankcase chamber 46*a* becomes higher than that in the crankcase chamber 46*b* the lubricant in the scavenging passage 52 is sprayed onto the larger end 44*a* of the connecting rod 44*b* through opening 51*a*, check valve 56*a* and ejection opening 53*b*.

Although the invention has been shown and described in terms of some preferred embodiment thereof, it should be understood that many changes and modifications are obvious to one skilled in the art without departing from the scope of the invention as defined in the appended claims.

What is claimed is:

1. In a two-cycle internal combustion engine comprising a cylinder, a crankcase defining a crankcase chamber, a crankshaft supported for rotation in the crankcase chamber, a piston in the cylinder, said piston being hollow and defining a chamber closed at the top and open at the bottom such that the chamber within the piston is at all times in communication with the crankcase chamber, a connecting rod connected at one end to the crankshaft and at its other end to the piston, said cylinder containing intake, exhaust and scavenging ports arranged in circumferentially-spaced relation to each other to be alternately covered and uncovered by reciprocation of the piston and the cylinder so that during the compression stroke, a fuel mixture is compressed in the cylinder above the piston and a fuel mixture is sucked into the crankcase chamber below the piston and during the exhaust stroke, burned gases are discharged through the exhaust port and the fuel mixture sucked into the crankshaft chamber is forced into the chamber above the piston through the inlet port; the improvement comprising circumferentially-spaced perforations through the wall of the piston providing direct communication between the chamber within the piston and the wall of the cylinder through which the fuel mixture is caused to be forced by the pressure generated in the crankcase chamber during the exhaust stroke and spread by reciprocation of the piston against the wall of the cylinder to thus lubricate the same and wherein none of the perforations overlap the exhaust port, but certain of the perforations overlap the intake port and scavenging port.

2. A two-cycle engine according to claim 1 wherein only minor portions of the overlapping perforations overlap said intake and scavenging ports.

3. A two-cycle engine according to claim 1 wherein said perforations are of different size and wherein the perforations of larger size are located at opposite sides of the exhaust port.

4. In a crankcase chamber compression type two cycle internal combustion engine of the type comprising a cylinder, a piston reciprocating in said cylinder, a crankcase chamber defined by a crankcase, a crankshaft rotatably supported by said crankcase, a connecting rod for operatively connecting said piston to said crankshaft, a scavenging passage adapted to communicate said crankcase chamber with a combustion chamber in said cylinder through at least one scavenging port provided through the side wall of said cylinder and opened and closed by the reciprocating movement of said piston, an intake passage communicated with said crankcase chamber through an intake port, and an exhaust passage communicated with said combustion chamber in said cylinder through an exhaust port, the improvement wherein the side wall of said piston is provided with perforations for bringing the cylinder wall into direct contact with a fresh fuel-air mixture sucked into the crankcase chamber at both sides of said exhaust port of said cylinder which are not facing said exhaust port, said perforations including a portion not facing said intake port and said scavenging port and wherein said perforations are located such that there are two such perforations close to the exhaust port, one at each side thereof, but in non-overlapping relation thereto.

* * * * *